US008123451B2

(12) United States Patent
Claydon et al.

(10) Patent No.: US 8,123,451 B2
(45) Date of Patent: Feb. 28, 2012

(54) METHOD OF AND APPARATUS FOR FORMING A CLOSURE

(75) Inventors: Paul Charles Claydon, Wantage (GB); Jason John Hall, Sandford-on-Thames (GB)

(73) Assignee: Crown Packaging Technology, Inc., Alsip, IL (US)

( * ) Notice: Subject to any disclaimer, the term of this patent is extended or adjusted under 35 U.S.C. 154(b) by 1078 days.

(21) Appl. No.: 11/720,764

(22) PCT Filed: Dec. 8, 2005

(86) PCT No.: PCT/EP2005/056600

§ 371 (c)(1), (2), (4) Date: Jun. 4, 2007

(87) PCT Pub. No.: WO2006/061411

PCT Pub. Date: Jun. 15, 2006

(65) Prior Publication Data

US 2009/0120043 A1 May 14, 2009

(30) Foreign Application Priority Data

Dec. 9, 2004 (EP) ..... 04270015

(51) Int. Cl.
*B21D 51/44* (2006.01)

(52) U.S. Cl. ..... 413/56; 413/8

(58) Field of Classification Search ..... 413/2, 8, 413/27, 42, 56, 67, 12, 13, 15, 17; 72/379.4; 53/487

See application file for complete search history.

(56) References Cited

U.S. PATENT DOCUMENTS

| | | | | | |
|---|---|---|---|---|---|
| 563,688 | A * | 7/1896 | Remy | 413/67 |
| 4,036,159 | A * | 7/1977 | Gane et al. | 413/17 |
| 4,458,469 | A * | 7/1984 | Dunn | 53/432 |
| 4,544,080 | A * | 10/1985 | Wright et al. | 220/359.2 |
| 4,574,607 | A * | 3/1986 | Akino et al. | 72/112 |
| 4,862,722 | A | 9/1989 | Fraze et al. | |
| 5,020,955 | A * | 6/1991 | Zumsteg | 413/8 |
| 5,395,005 | A * | 3/1995 | Yoshida | 220/359.2 |
| 6,004,089 | A * | 12/1999 | Legresy et al. | 413/17 |
| 6,561,004 | B1 * | 5/2003 | Neiner et al. | 413/2 |
| 2008/0253863 | A1 * | 10/2008 | Heyn | 413/4 |

FOREIGN PATENT DOCUMENTS

| | | | |
|---|---|---|---|
| EP | 0853054 | A2 | 7/1998 |
| WO | WO 03/006329 | A2 | 1/2003 |

OTHER PUBLICATIONS

International Search Report and the Written Opinion of the Searching Authority for International Application No. PCT/EP2005/05660 dated Mar. 17, 2006.

* cited by examiner

*Primary Examiner* — Teresa Ekiert
(74) *Attorney, Agent, or Firm* — Knoble Yoshida & Dunleavy, LLC

(57) ABSTRACT

A method and apparatus for forming a closure in which the closure includes a peelable panel with integral tab folded over the panel. The apparatus includes upper and lower reform tools, the upper reform tool having a tab relief feature and local scallops at each end of the tab relief. When reform tools move together for reforming, the tab relief feature is positioned over the tab fold and the scallops at the ends of the fold. As a result crushing and fracture of the tab during reforming is avoided.

9 Claims, 6 Drawing Sheets

[Fig. 004]
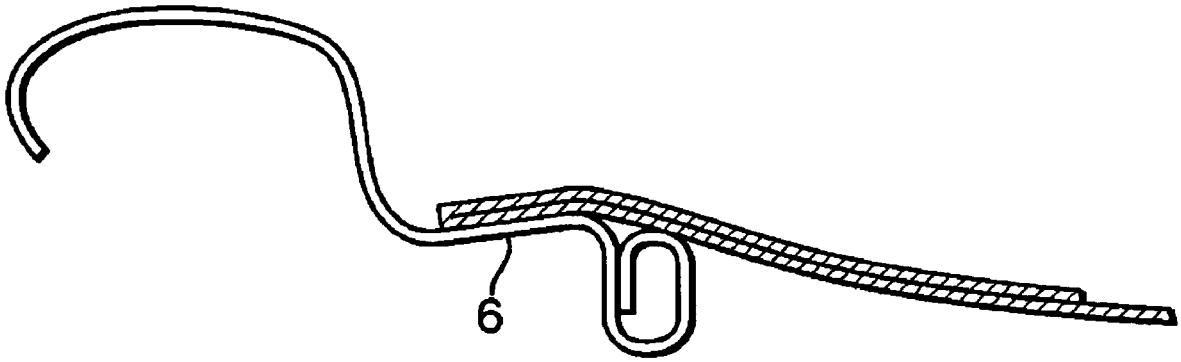
[Fig. 005]
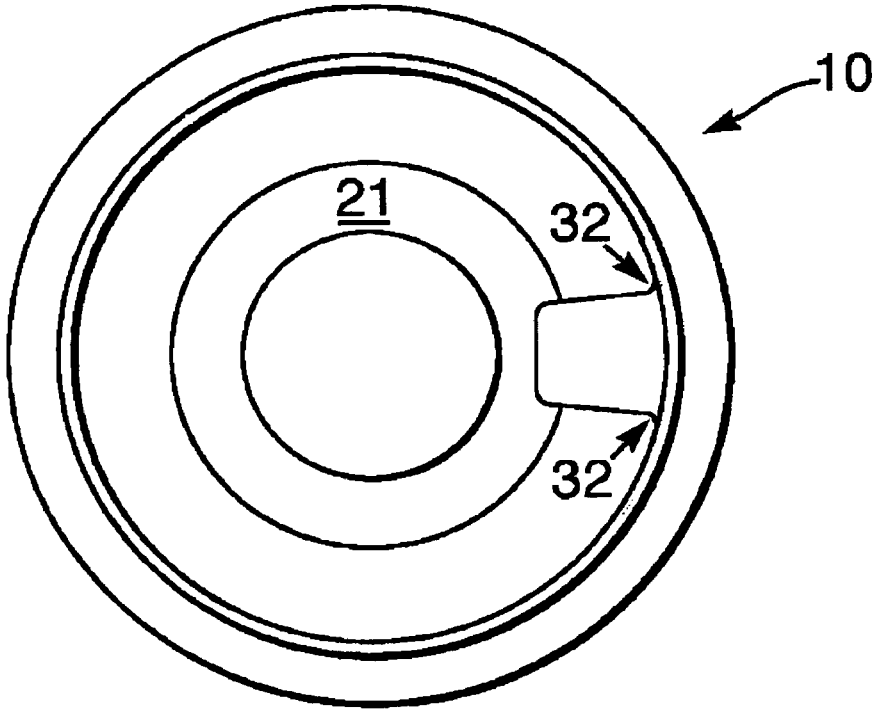

METHOD OF AND APPARATUS FOR FORMING A CLOSURE

TECHNICAL FIELD

This invention relates to a method of forming a closure and an apparatus for forming a closure. In particular, it relates to the formation of a closure which includes the fixing of a peelable panel and integral tab to an annular component to form a lid, and an apparatus for seaming the lid to a container body.

BACKGROUND ART

PCT patent application no. PCT/EP04/006723 describes a method of controlling in-can pressure during thermal processing by bonding a diaphragm or "foil" panel of lidding material such as aluminium/polymer laminate or aluminium coated with lacquer to an annular component. The thickness of the aluminium in the material of this panel is at least 60 microns, preferably about 70 to 80 microns. In the method of PCT/EP04/006723 the panel is stretched and the annular component and panel bonded thereto are fixed to a filled can. During thermal processing the closure panel assumes a generally dome shaped profile so as to provide an increase in can volume.

In this type of closure, the annular component or ring includes a substantially flat sealing surface extending radially inwardly from a wall and the foil panel is fixed to the sealing surface so that the panel is substantially in the same plane as the sealing surface. The sealing surface is then reformed to an angle of 15° to 25° relative to the transverse plane of the closure and the foil panel is profiled to a domed or beaded shape. The provision of a domed or beaded shape reduces the pressure difference experienced by the panel due to the volume increase this profile gives.

DISCLOSURE OF INVENTION

Closures such as that described in PCT/EP04/006723 are typically intended for closing containers for food. The closure must be capable of maintaining seal integrity during processing, sterilisation etc. without damage to the peelable foil panel. However, the closure must also be capable of being readily opened by gripping of the tab for access to the food.

Conventionally, cans closed by peelable ends are processed in overpressure retorts, where in-can pressure generated additional to the vapour pressure of the steam (differential pressure) during the sterilisation process may be balanced by the introduction of air pressure. The use of retorts which do not offer use of overpressure ("non-overpressure retorts"), or higher volume throughput retorts such as hydrostatic retorts which do not offer the overpressure facility is currently prevented because of the risk of bursting of the seal around the foil panel due to excessive differential pressure.

During fixing of the panel to the sealing surface of the ring, the tab is folded vertically, and then in a follow-up operation it is folded back over the seal. Furthermore, during reforming of the flat seal surface, to which the foil panel is bonded, to an inclined profile, the fold of the tab is put under stress which could potentially lead to tab fracture and tearing of the panel on opening.

According to the present invention, there is provided an apparatus for forming a closure for fixing to an open end of a container body, the closure comprising: an annular component including a substantially flat sealing surface extending radially inwardly from a wall; a diaphragm fixed to the sealing surface and having a tab extending from its periphery, the diaphragm being substantially in the same plane as the sealing surface, and comprising a lidding material of aluminium/polymer laminate or aluminium coated with lacquer, the thickness of the aluminium in the lidding material being at least 60 microns. The apparatus includes upper and lower reform tools for reforming the sealing surface angle, the lower reform tool having a profile with an angle of 15.degree. to 25.degree., the upper reform tool having a nose for locating between the wall and the sealing surface of the annular component, and a reform surface extending radially inwardly from the nose; the lower reform tool including a complementary reform surface; and in which the nose is relieved over an arc Φ which, in use, is positioned over the tab, the depth of this tab relief being at least equal to the thickness of the lidding material whereby crushing of the tab in the region of the tab relief is avoided.

Springback of ring material during reforming may lead to a sealing surface angle of less than 15°, even as low as 10°, depending on ring material.

By relieving the surface of the nose in the position which, in use, will lie over the tab, the folded tab is only pressed by the same amount as the remainder of the periphery of the diaphragm during reforming and crushing of the tab fold is avoided. The reform surface may extend radially inwardly from the nose at an angle of approximately 20° relative to the transverse plane of the reform tool. This imparts a corresponding incline to the sealing surface, less any springback of the ring material.

Preferably, the upper reform tool further comprises local scallops at each edge of the tab relief. Folding of the tab over the diaphragm panel will occur along a straight line, effectively a chord. Consequently, the ends of the folded tab chord extend slightly up the wall of the ring (i.e. the annular component). The scallops on the upper reform are like a spur relief which is situated in the position of the ends of the tab fold. This prevents any load being applied to the fold ends which would otherwise crush the tab, leading to splitting of the tab and tear of the panel on opening.

The tab relief feature of the present invention may be used with benefit irrespective of tab shape. For example, the tab shape may be annular, rectangular, trapezoidal (with tab fold being the widest part of the trapezium) or "inverted" trapezoidal (with the tab fold being the narrowest part of the trapezium). Use of the apparatus of the present invention with a diaphragm having a tab of the "inverted" trapezoidal shape has been found not only to avoid tab damage during sealing to the annular component, but also to produce a closure with reduced opening force and improved seal strength.

The apparatus may also include upper and lower inserts for stretching and/or profiling the lidding material. This shape enables the closure panel to deform during thermal processing to a generally dome shaped profile to the panel so as provide an increase in can volume.

According to another aspect of the present invention, the apparatus further comprises a chuck for seaming the closure to a container body, the lower part of the chuck having a profile which differs from the profile of the closure wall so as to provide at least clearance with the closure.

For seaming of the can end, it is not possible to orient the can to the seaming chuck. It is thus not possible to orient the folded tab to a position relative to the seaming chuck. By using a seaming chuck which has a different profile from that of the can end wall where it meets the sealing surface, for example by a mismatch of radii, direct pressure onto the tab fold is avoided.

Alternatively, the lower part of the outer wall of the seaming chuck may have a different angle from the upper part, the angle of the lower part providing clearance from the closure wall. This dual angle performs the same function as a seaming chuck having a radial mismatch. The seaming load is directed to the flat region and radiused region outside the inclined seal surface to avoid flattening of the incline angle.

According to yet another aspect of the present invention a method of forming a closure, comprises providing an annular component including a substantially flat sealing surface extending radially inwardly from a wall; fixing a diaphragm to the sealing surface, the diaphragm being substantially in the same plane as the sealing surface; reforming the sealing surface by an angle of 15° to 25°; and, optionally, profiling the diaphragm to a domed or beaded shape.

The method may further comprise fixing the closure to a container body, the container body remaining open at the end opposite to the closure, filling the container through its open end so that product contacts the diaphragm of the closure, and reducing the pressure within the container body, whereby the diaphragm assumes an externally concave or domed shape. Clearly in this embodiment it is not necessary to stretch or profile the diaphragm prior to fixing the closure to an empty can. During the "vacuum" filling process the closure assumes a generally domed profile so as to provide a reduction in can volume. Typically the "vacuum" filling process pulls 0.8 bar during filling.

The method of the invention may be used with benefit for all tab profiles as described above. The inverted trapezium profile being particularly preferred.

The reforming step may comprise locating a nose of the reform tool between the wall and the sealing surface of the annular component, the nose being relieved over an arc which, in use, is positioned over the tab, the depth of this tab relief being at least equal to the thickness of the lidding material whereby crushing of the tab in the region of the tab relief is avoided.

BRIEF DESCRIPTION OF THE DRAWINGS

FIGS. 1 to 4 are schematic side sections showing the progression of forming a can end using the apparatus and method of the present invention;

FIG. 5 is a plan view of the closure of FIG. 4;

MODE FOR THE INVENTION

Figure 1:
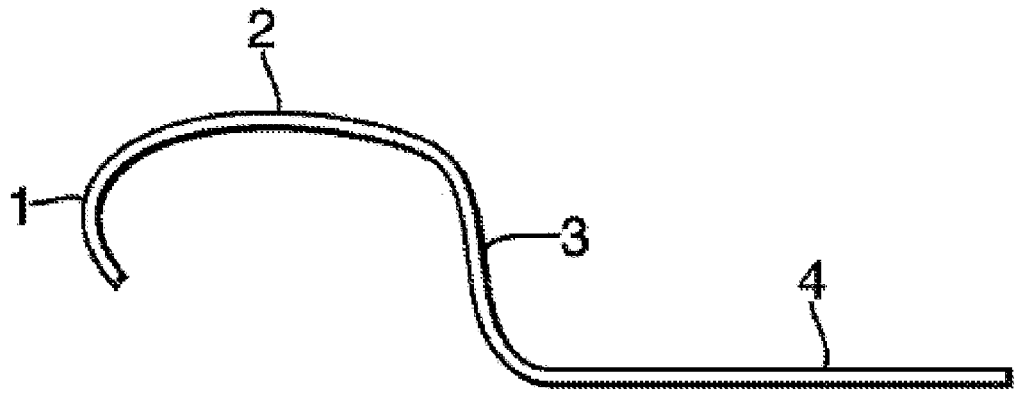
Figure 2:
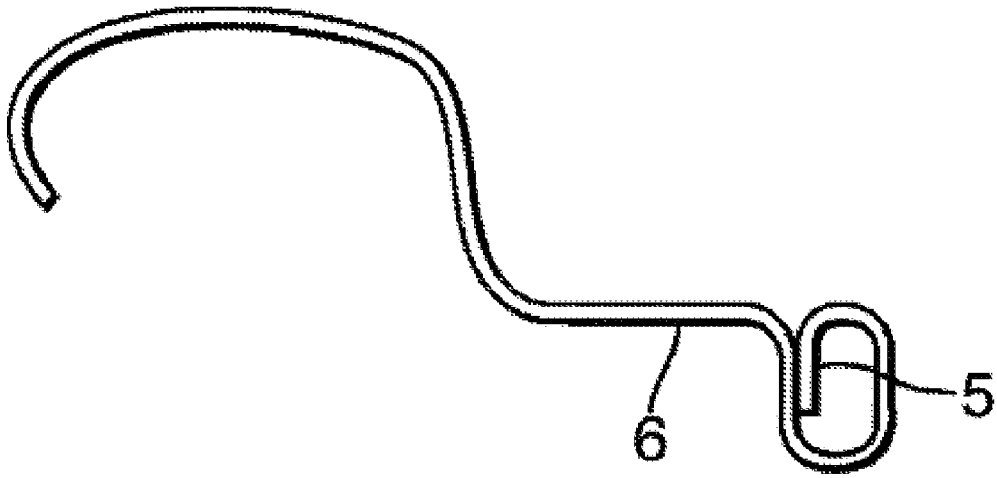

FIGS. 1 to 4 show the progression of forming a can end. A can end profile is first pressed out of metal sheet into the form shown in FIG. 1, comprising a seaming flange 1, seaming panel 2, wall 3 and centre panel 4. To form a ring, a disc is cut out of panel 4 and the cut inner edge is "hidden" by curling the edge 5, leaving only a flat annular surface 6 of the original centre panel. The upper edge of curl 5 is in the same plane as the annular surface, as shown in FIG. 2.

In the next progression of forming the can end, a foil panel 7 is bonded to the surface 6 of the ring. The foil panel includes an integral tab 8 which is folded over the panel. It can be seen from the end 9 of FIG. 3 that there is thus a double thickness of panel in the region of tab 8.

In accordance with the invention, the ring and panel are then reformed to a profile such as that of FIG. 4 in which the sealing surface 6 is at an angle of about 15°. In the plan view of FIG. 5, the finished and reformed end 10 has a beaded profile.

Figure 3:
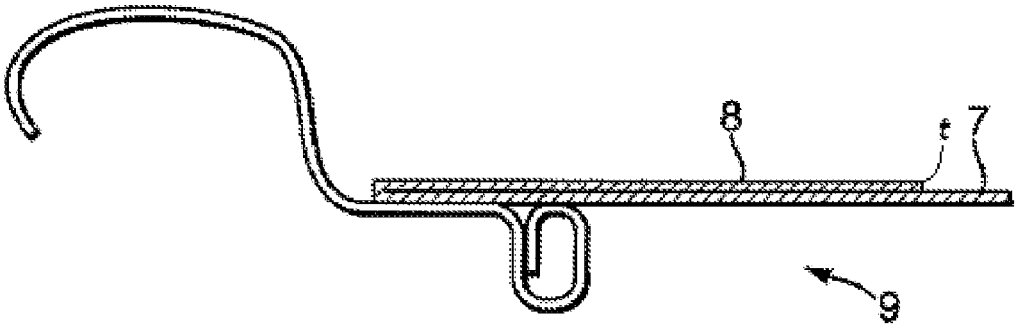
Figure 6:
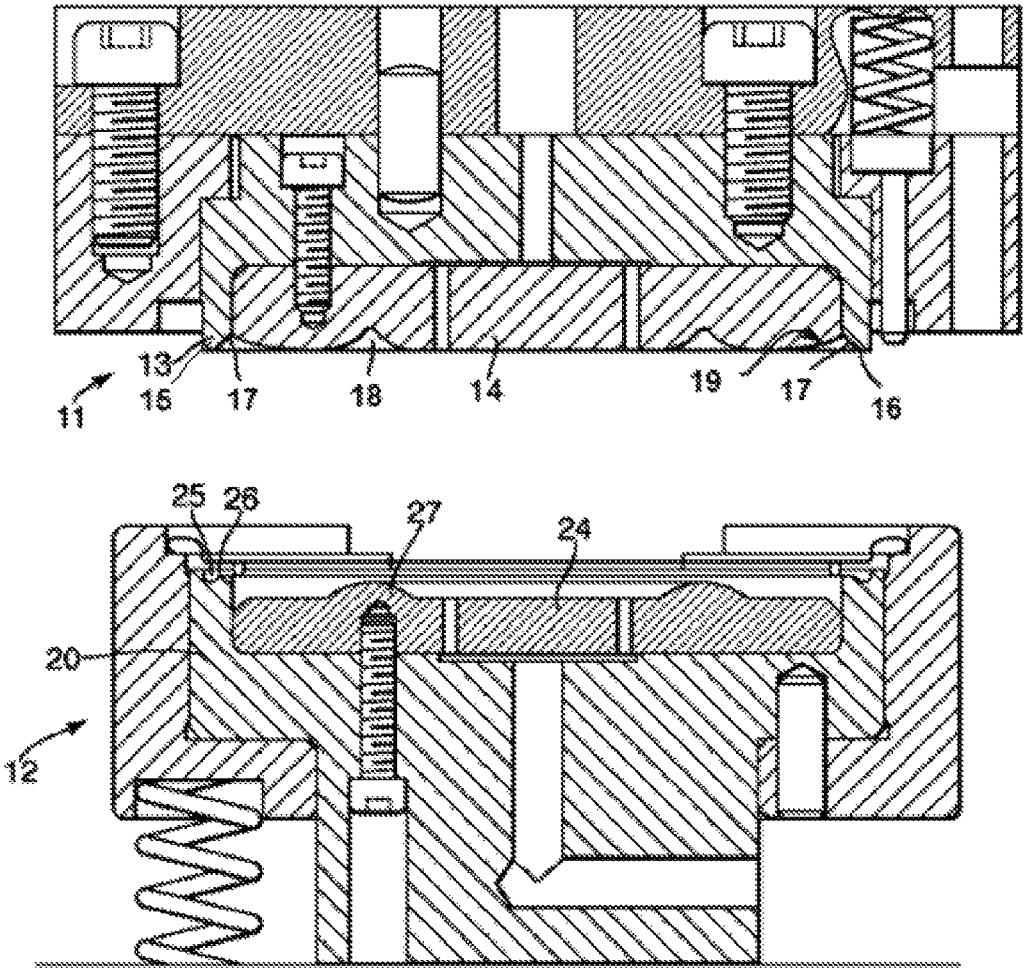
FIG. 6 is a side sectional view of the apparatus for forming the closure of FIGS. 4 and 5.
Figure 7:
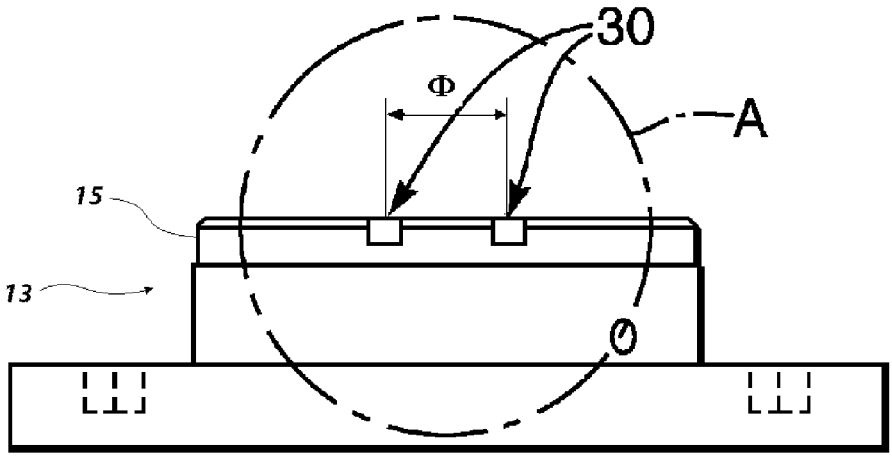
FIG. 7 is a side view of the tab reform feature of the upper reform tool of FIG. 6.

The apparatus for reforming the can end of FIG. 3 into the beaded profile of FIGS. 4 and 5 is shown in FIG. 6. The apparatus comprises upper and lower reforming tools 11,12. An end 9 similar to that of FIG. 3 is shown in position on the lower reform tool 12.

Upper tool 11 comprises an upper panel form 13 within which an upper insert 14 is fixed. The upper panel form comprises a nose 15 for locating between the wall 3 and the sealing surface 6 of the can end, the nose comprising a radiussed portion 16 and an upwardly inclined forming surface 17. Lower panel form 20 has corresponding radiussed portion 25 and forming surface 26. Lower insert 24 is fixed within lower panel form 20.

Upper and lower inserts 14, 24 are shaped according to the desired profile for the foil panel 7 and the required barometric movement according to the retorting process to be used, for example. In the example shown in FIG. 6, the inserts are shaped to form the foil panel into an annular outwardly convex bead 21 such as that shown in FIG. 5. Complementary shaped profiles 18, 27 on the upper and lower inserts form this bead but could clearly be adapted to domed or other shapes as required. The edge of upper insert 14 is profiled at 19 so as to form the foil panel at a tangent to the upper surface of curl 5, the curl 5 being located in the bottom tool.

Figure 8:
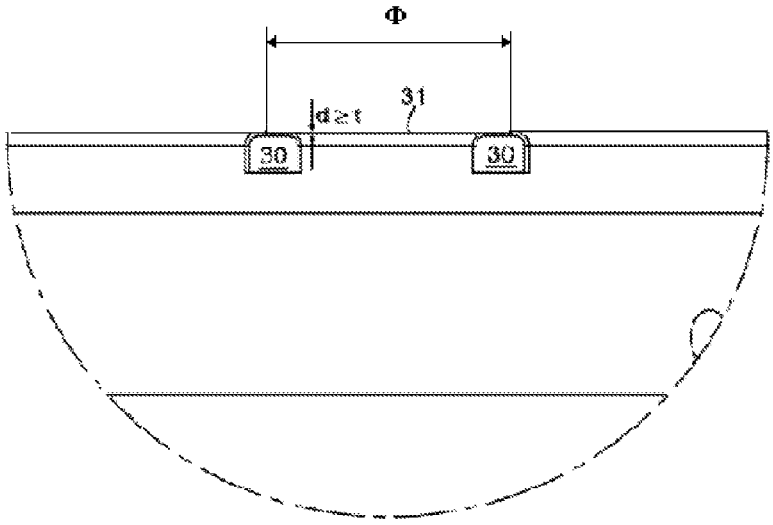
FIG. 8 is an enlarged view of detail A in FIG. 7.

The upper panel form 13 is adapted to reform the sealing surface 6 of a ring to which a foil diaphragm having a folded tab 8 is fixed. Spur relief scallops 30 and tab relief 31 in the upper panel form are adapted to avoid fracture of the tab fold during reforming to a barometric shape such as that of FIG. 5. Tab relief feature 31 as shown has at least the same depth 'd' as the thickness 't' of the tab 8, i.e. greater than one foil thickness. This is indicated on FIG. 8 where $d \geqq t$.

Spur relief scallops 30 in the upper panel form 13 extend radially inwardly from the outer edge of the upper panel form in the position where, in use, the ends of the folded edge of the tab are situated. These are the positions indicated by reference 32 in FIG. 5.

In use, the can end is placed on the lower insert 24 as shown in the bottom half of FIG. 6 and the upper tool 11 is lowered onto the bottom tool 12 (or vice-versa). The lower extremities of the upper tool will clearly contact the end first, i.e. the radius 16 of the upper panel form and the lower edges of beads or other convex features 18 and the central flattened dome feature.

As the tools move together with the can end sandwiched between, the seal surface 6 is reformed to the angled position of FIG. 4 and the beaded foil panel is formed as best seen in FIG. 5.

The finished end is seamed onto a filled can or empty can in conventional manner. However, in accordance with another aspect of the invention, the seaming chuck is also adapted to avoid damage to the tab. During seaming, it is not possible to orient the closure to the seaming chuck and so any relief feature on the seaming chuck must be fully circumferential.

Figure 9:
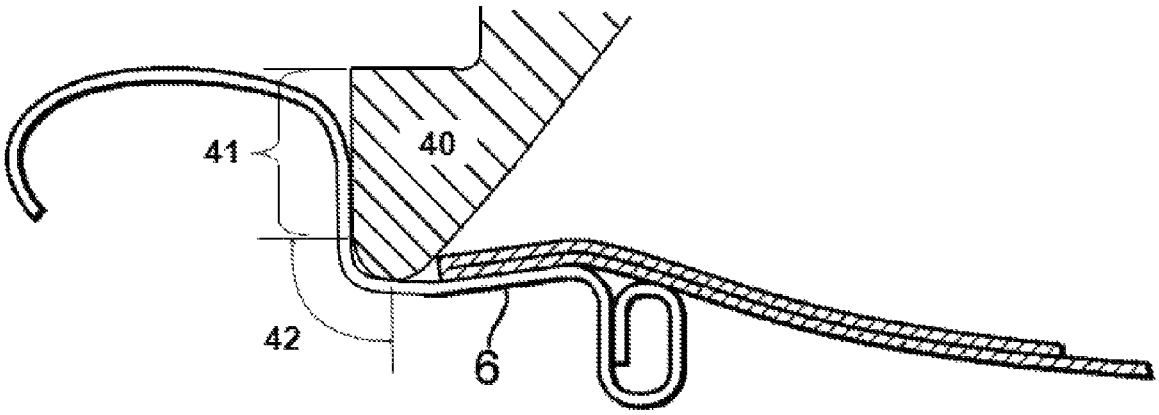
FIG. 9 is a side view of a first embodiment of the seaming chuck of the invention.

One type of seaming chuck which is suited for use with the closure of the invention has a cylindrical portion which fits tightly against an upright wall of the can end. The lower edge of the seaming chuck comprises an annulus which has a profile (in its most simple form a radius) which is mismatched with the profile of the can end, in the region where the wall 3 becomes the sealing surface panel. FIG. 9 shows such a seaming chuck 40 with a cylindrical portion 41 and a radiused portion 42 which is mismatched from the profile of the can end in the region where the wall 3 becomes the sealing surface panel 6.

Figure 10:
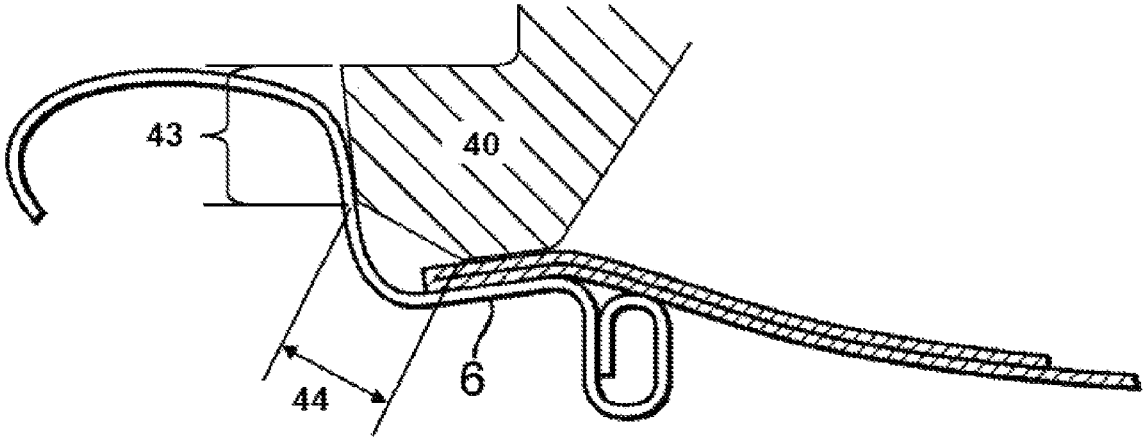
FIG. 10 is a side view of a second embodiment of the seaming chuck of the invention.

In an alternative embodiment shown in FIG. 10, the seaming chuck 40 has a shorter upper wall portion 43 and a dual angle. This dual angle is provided by the lower part 44 of the chuck 40 having a profile which differs from the profile of the wall 3. This allows the chuck to have clearance between the lower part of the chuck side wall and the wall of the can end. As with the first type of seaming chuck, this provides clearance from the tab fold and avoids crushing and potential fracture of the tab

The invention claimed is:

1. An apparatus for forming a closure for fixing to an open end of a container body, the closure comprising:

an annular component including a substantially flat sealing surface extending radially inwardly from a wall;

a diaphragm fixed to the sealing surface, the diaphragm being substantially in the same plane as the sealing surface, and having a tab extending from its periphery, the tab folded over the diaphragm;

in which the apparatus includes:

upper and lower reform tools for reforming a sealing surface angle, the lower reform tool having a profile with an angle of 15° to 25°, the upper reform tool having a nose for locating between the wall and the sealing surface of the annular component, and a reform surface extending radially inwardly from the nose;

the lower reform tool including a complementary reform surface;

wherein the nose is relieved over an arc positioned over the tab, wherein a depth of a tab relief is at least equal to the thickness of a lidding material from which the diaphragm is made, whereby crushing of the tab in the region of the tab relief is avoided, wherein the tab relief is located on the upper reform tool.

2. An apparatus according to claim 1, in which the upper reform tool further comprises local scallops at each edge of the tab relief.

3. An apparatus according to claim 1, further including upper and lower inserts for stretching and/or profiling the diaphragm material.

4. An apparatus according to claim 1, in which the reform surface extends radially inwardly from the nose at an angle of approximately 20° relative to the transverse plane of the reform tool.

5. An apparatus according to claim 1, further comprising a chuck for seaming the closure to a container body, a lower part of the chuck having a profile which differs from a profile of the closure wall so as to provide at least clearance with the closure.

6. An apparatus according to claim 5, in which a lower part of the outer wall of the seaming chuck has a different angle from an upper part, whereby the lower part provides clearance from the closure wall.

7. An apparatus according to claim 1, in which the tab is provided with an inverted trapezoidal shape.

8. A method of forming a closure, the method comprising providing an annular component including a substantially flat sealing surface extending radially inwardly from a wall;

fixing a diaphragm to the sealing surface, the diaphragm being substantially in the same plane as the sealing surface;

reforming the sealing surface by an angle of 15° to 25°; further comprising fixing the closure to a container body, the container body remaining open at an end opposite to the closure, filling the container through its open end so that product contacts the diaphragm of the closure, and reducing the pressure within the container body, whereby the diaphragm assumes an externally concave or domed shape; wherein the reforming step comprises locating a nose of a reform tool between the wall and the sealing surface of the annular component, wherein the nose being relieved over an arc positioned over a tab, wherein a depth of a tab relief is at least equal to the thickness of the diaphragm whereby crushing of the tab in the region of the tab relief is avoided, wherein the tab relief is located on the reform tool.

9. A method of forming a closure, the method comprising providing an annular component including a substantially flat sealing surface extending radially inwardly from a wall;

fixing a diaphragm to the sealing surface, the diaphragm being substantially in the same plane as the sealing surface;

reforming the sealing surface by an angle of 15° to 25°; further comprising folding a tab, which extends from the periphery of the diaphragm, over a periphery of the diaphragm;

wherein the reforming step comprises locating a nose of a reform tool between the wall and the sealing surface of the annular component, wherein the nose being relieved over an arc positioned over a tab, wherein a depth of a tab relief is at least equal to the thickness of the diaphragm whereby crushing of the tab in the region of the tab relief is avoided, wherein the tab relief is located on the reform tool.

* * * * *